US005607115A

United States Patent [19]

Frech

[11] Patent Number: 5,607,115

[45] Date of Patent: Mar. 4, 1997

[54] BOBBIN WINDING MACHINE ADAPTED TO RECEIVE DIFFERENT TRAVERSING DEVICES AND WING TRAVERSING DEVICE HAVING MULTIPLE WING UNITS

[75] Inventor: Peter Frech, Wallisellen, Switzerland

[73] Assignee: Maschinenfabrik Rieter AG, Winterthur, Switzerland

[21] Appl. No.: 235,528

[22] Filed: Apr. 29, 1994

[30] Foreign Application Priority Data

Apr. 29, 1993 [CH] Switzerland ..... 01300/93

[51] Int. Cl.[6] ..... B65H 54/28; B65H 57/28

[52] U.S. Cl. ..... 242/43 A; 242/43 R; 242/43.2; 242/158 R

[58] Field of Search ..... 242/43 R, 43 A, 242/158 R, 158.3, 158.5, 43.2

[56] References Cited

U.S. PATENT DOCUMENTS

| | | | |
|---|---|---|---|
| 3,489,360 | 1/1970 | Torsellini et al. | 242/43 |
| 3,908,919 | 9/1975 | Hermanns | 242/158.5 |
| 4,674,694 | 6/1987 | Hasegawa et al. | 242/43 R |
| 4,991,783 | 2/1991 | Sugioka | 242/43 A |
| 5,048,769 | 9/1991 | Wirz et al. | 242/43 R |
| 5,149,002 | 9/1992 | Sugioka | 242/43 A |
| 5,282,582 | 2/1994 | Sugioka et al. | 242/43 A |
| 5,318,232 | 6/1994 | Busenhart et al. | 242/18 A |

FOREIGN PATENT DOCUMENTS

| | | | |
|---|---|---|---|
| 0272458 | 6/1988 | European Pat. Off. . | |
| 0322752 | 7/1989 | European Pat. Off. . | |
| 322752 | 7/1989 | European Pat. Off. | 242/43 A |
| 0382104 | 8/1990 | European Pat. Off. . | |
| 2206264 | 6/1974 | France . | |
| 1710068 | 10/1971 | Germany . | |
| 212240 | 8/1984 | Germany | 242/43 R |
| 3833085 | 4/1989 | Germany . | |
| 511182 | 9/1971 | Switzerland . | |
| 01983/91 | 7/1991 | Switzerland . | |

*Primary Examiner*—William Stryjewski
*Attorney, Agent, or Firm*—Burns, Doane, Swecker & Mathis, LLP

[57] ABSTRACT

In order to simplify the changing of a traversing mechanism depending on the yarn conditions, an insertable and exchangeable traversing device is provided in a bobbin winding machine. The traversing mechanism either guides the yarn by way of a so-called cam cylinder traversing device or by way of a so-called wing traversing device which guides the yarn through rotation of traversing wings. The traversing device is arranged substantially opposite a contact roller so that a yarn to be wound up is guided to-and-fro by way of a thread guide in accordance with a stroke length and is deposited on a yarn package via the contact roller. The wing traversing device includes upper and lower wings, with the upper wings being held in a stationary manner in an overall base plate, while the lower wings are held rotatably in unit base plates. The unit base plates are swivellable about a rotational axle in such a way that the lower wings can be swivelled from an operating position to an idle position so as to enable the quick and easy exchange of the lower wings.

30 Claims, 10 Drawing Sheets

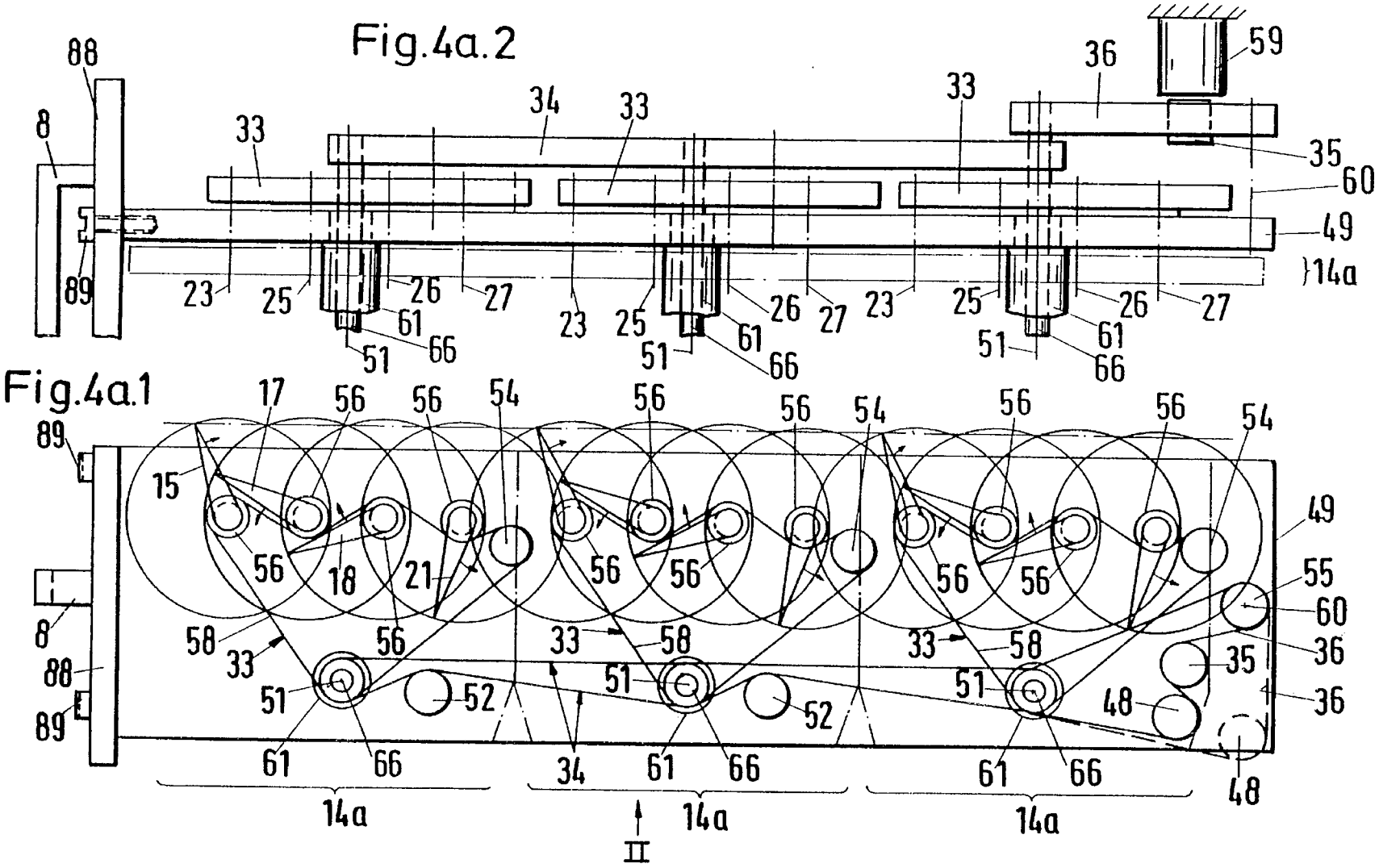
Fig.4a.2
Fig.4a.1
II

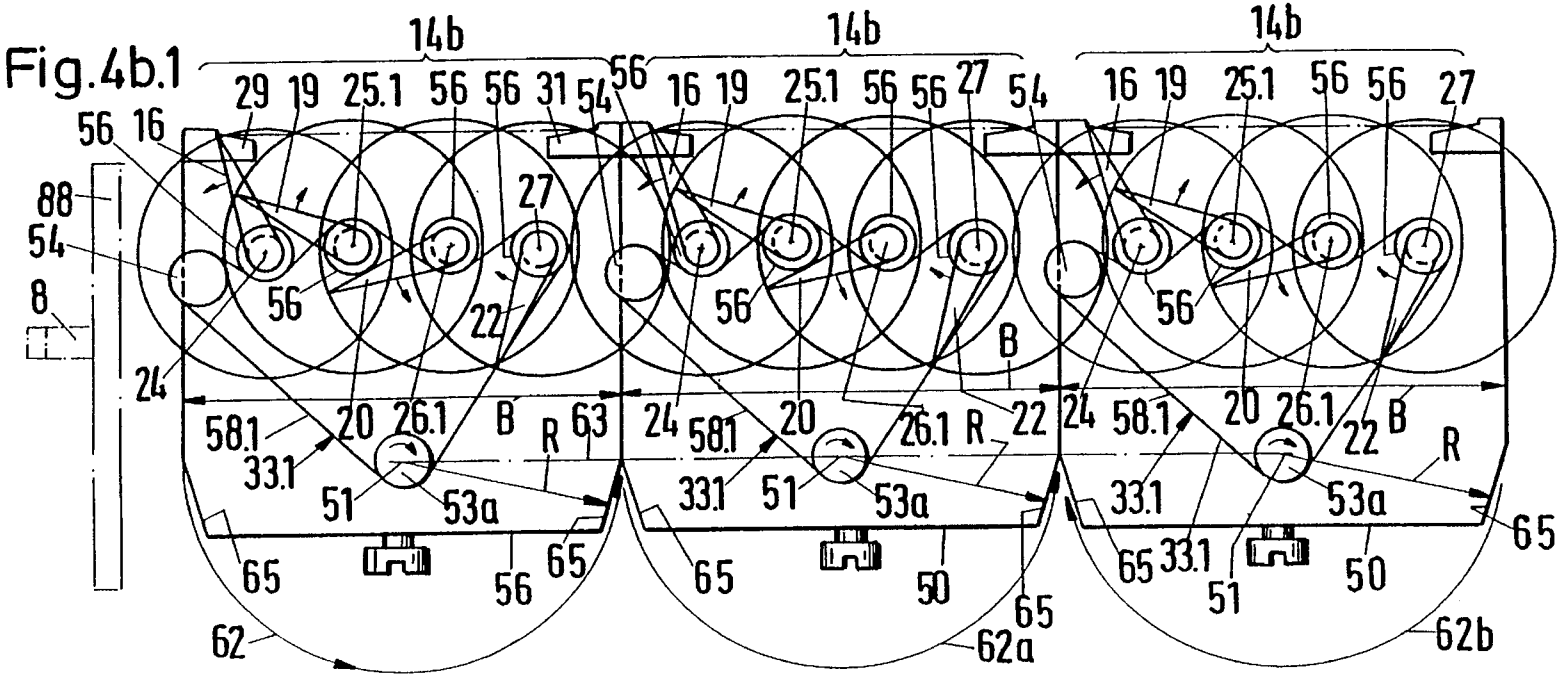
Fig.4b.1
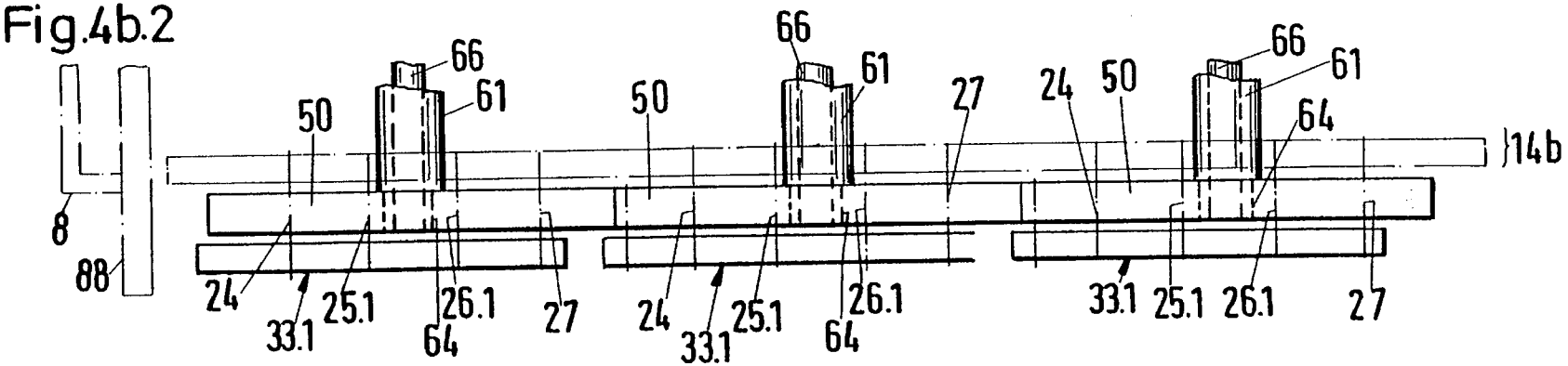
Fig.4b.2

Fig.5a.1
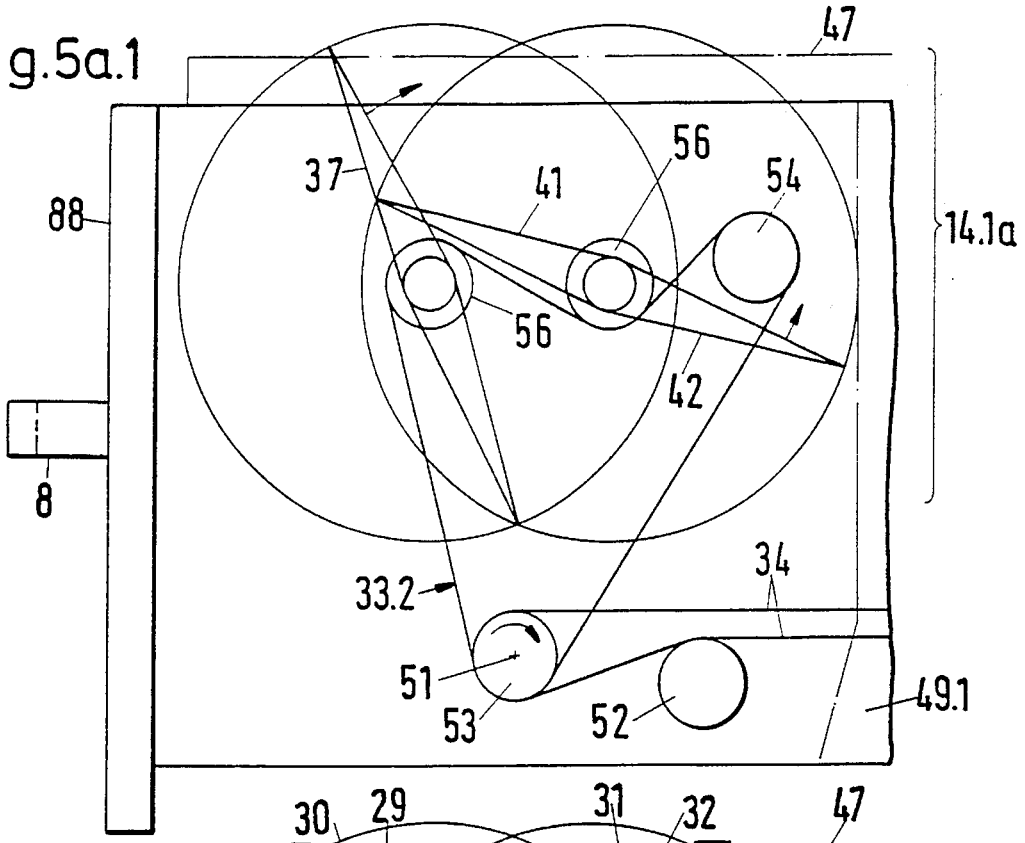
Fig.5b.1
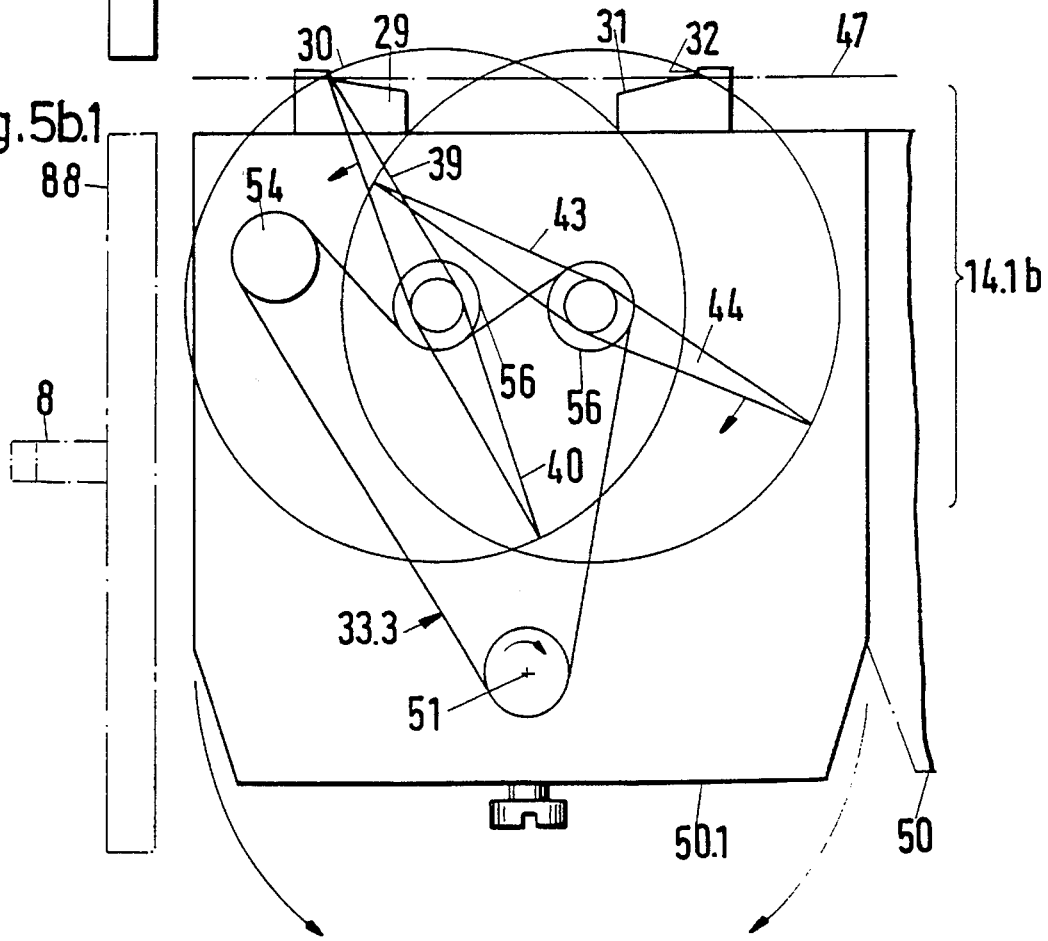

BOBBIN WINDING MACHINE ADAPTED TO RECEIVE DIFFERENT TRAVERSING DEVICES AND WING TRAVERSING DEVICE HAVING MULTIPLE WING UNITS

FIELD OF THE INVENTION

The invention relates to a bobbin winding machine and more specifically to a bobbin winding machine for winding at least one textile yarn, in particular a yarn made from a synthetic endless filament, with at least one chuck for receiving the yarn and a contact roller for transferring the yarn guided by a traversing device to the chuck.

BACKGROUND OF THE INVENTION

A bobbin winding apparatus is known, for example, from German Publication No. 1710068 and from European Patent Application No. 0322752A1, as well as from U.S. Pat. No. 4,674,694. These spinning machines are provided with a single chuck.

A bobbin winding machine with two chucks is disclosed in patent application number CH 01983/91 of the applicant. This machine carries out a change in the bobbins by means of a revolving bobbin changer, in which a full bobbin is automatically exchanged for an empty tube without interrupting the winding process.

Furthermore, European patent application publication No. 0272458A1 of the same applicant and corresponding U.S. Pat. No. 5,048,769 also show a bobbin winding machine with two chucks, in which the traversing device is an exchangeable traversing module which rests on a support element provided in the machine.

The traversing device comprises in the latter application a cam cylinder with a thread guide that is guided in the groove of the cam cylinder for traversing the yarn, whereas the two patent specifications mentioned first are provided with so-called wing traversing devices which convey the yarn in the two traversing devices for building a package.

Cam cylinder traversing devices and wing traversing devices each have their own fields of application and are individually utilized depending upon their respective purposes.

OBJECT OF THE INVENTION

It is the object of the present invention to provide higher flexibility in being able to change the differing fields of application of the wing traversing device and the cam traversing device, and to also permit higher flexibility in changing the parts which are subject to wear and tear.

The advantages of the invention are, on the one hand, that for all fields of application only one bobbin winding machine is required, in which—according to the requirements—either a traversing device with a cam cylinder as disclosed in EP-0272458A1, for example, or a traversing device with wings as described below can be inserted into the bobbin winding machine, and, on the other hand, that it is possible to clean or exchange in a simple manner the wings of the wing traversing device without separating the traversing units from their drive.

BRIEF DESCRIPTION OF THE DRAWING FIGURES

The invention is outlined in greater detail below with reference to the accompanying drawings in which like elements bear like reference numerals and wherein.

Figure 1:
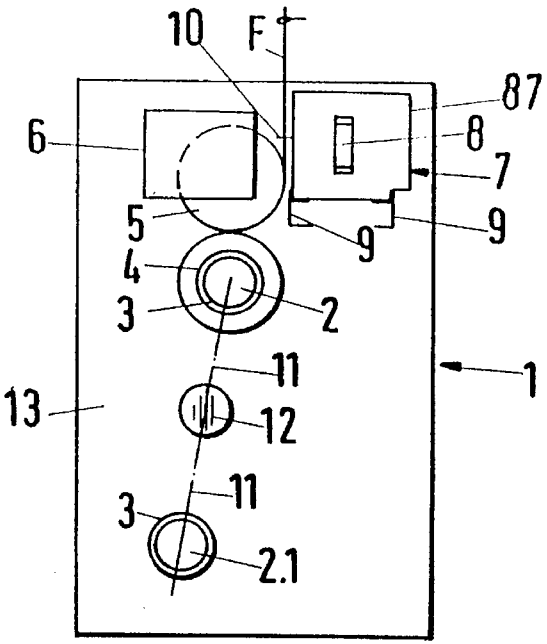
FIG. 1 is a semi-schematic front view of a bobbin winding machine in accordances with the invention.
Figure 2:
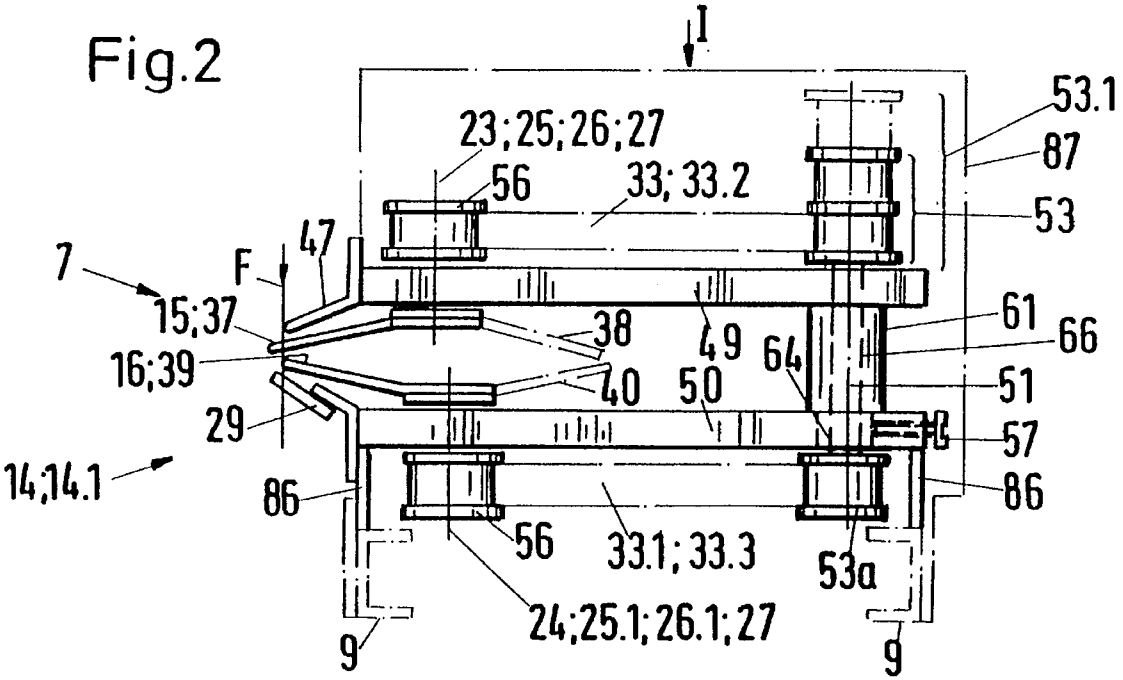
FIG. 2 is a cross-sectional view of a wing traversing unit in accordance with the invention of a traversing device of the bobbin winding machine of FIG. 1, shown in a semi-schematic view and in closed form.
Figure 3:
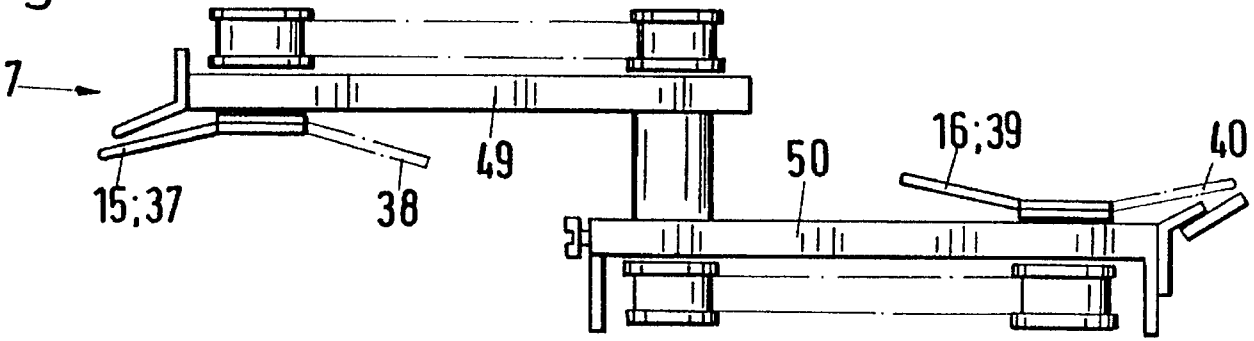
FIG. 3 shows the traversing unit of FIG. 2 in opened form.
Figure 4:
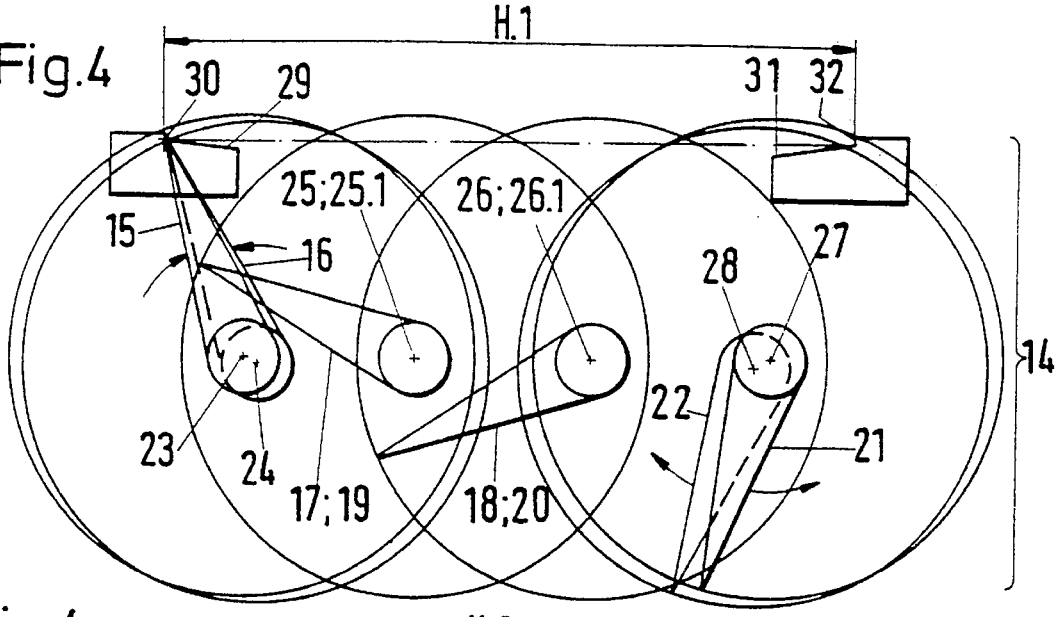
Figure 4A:
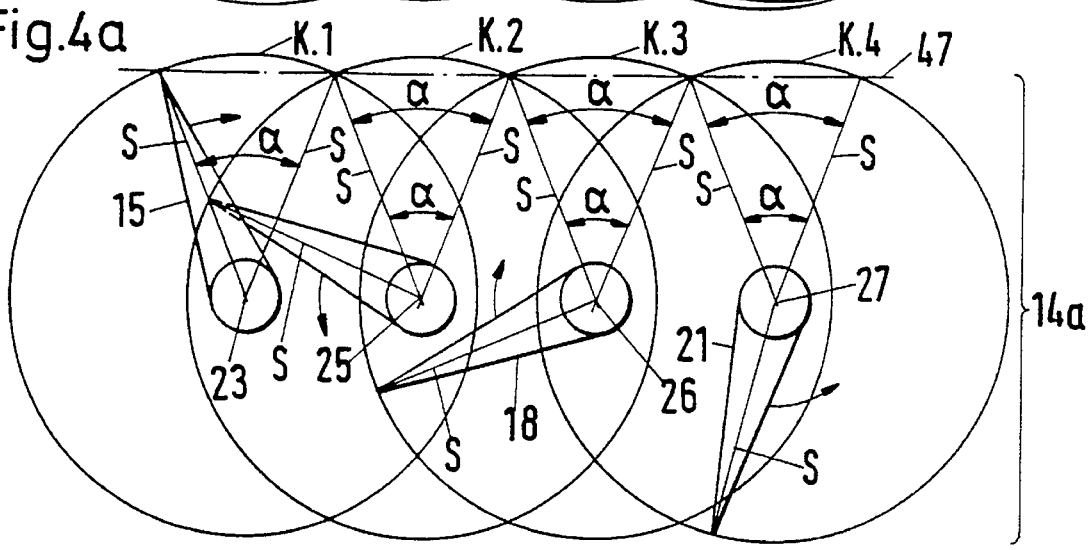
Figure 4B:
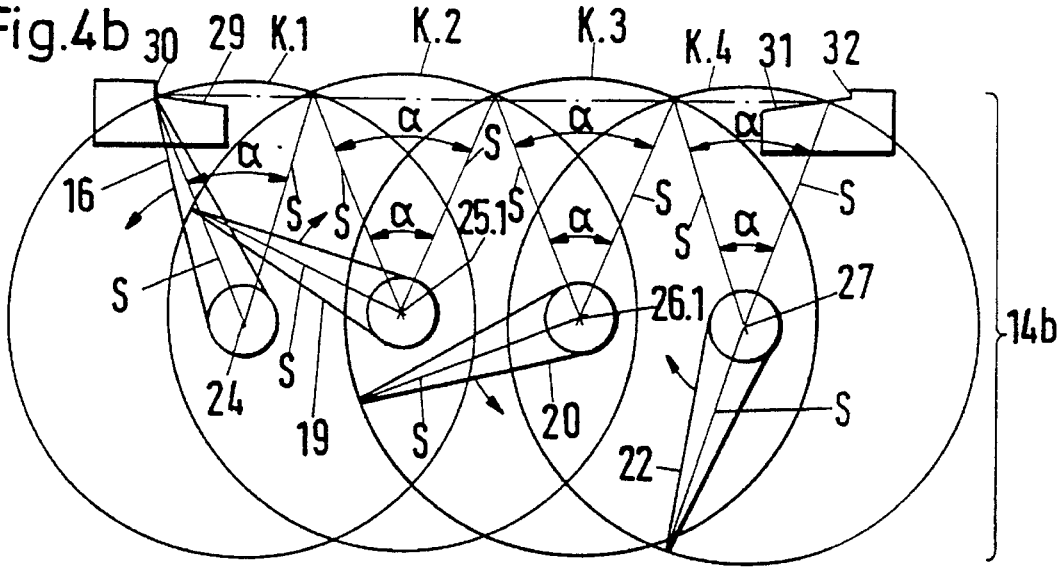
Figure 5:
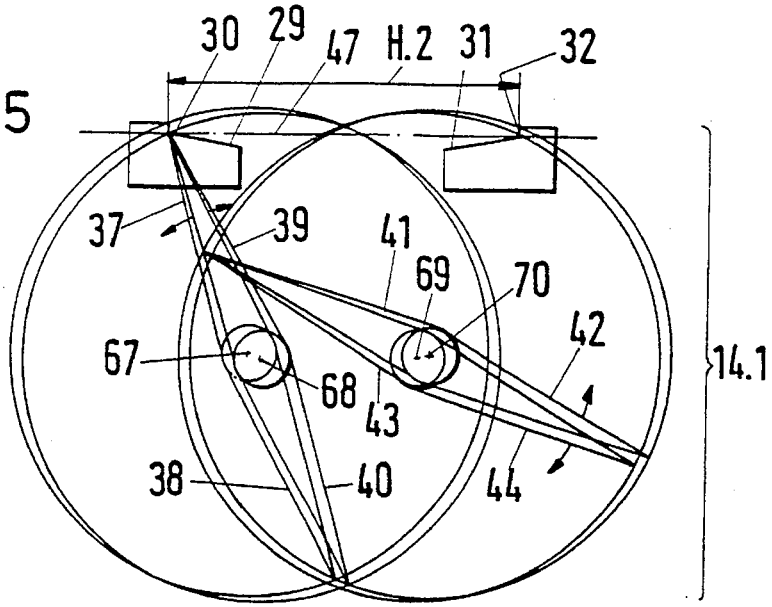
Figure 5A:
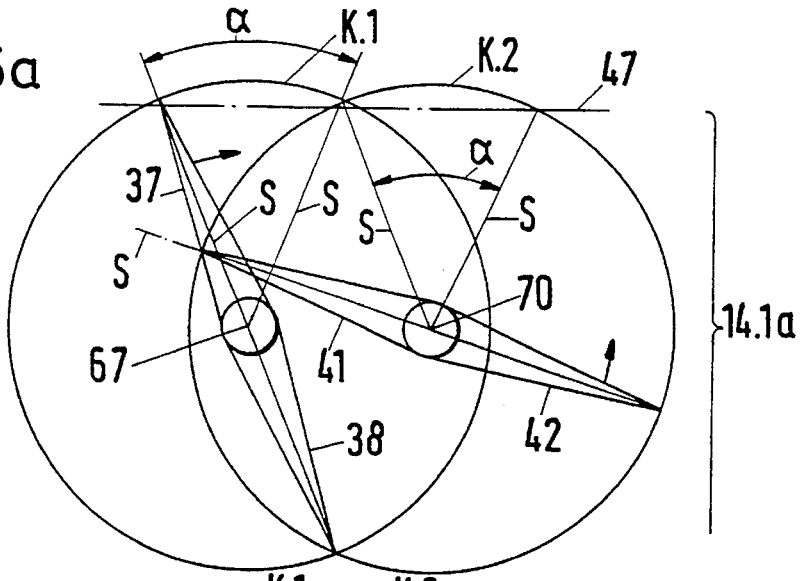
Figure 5B:
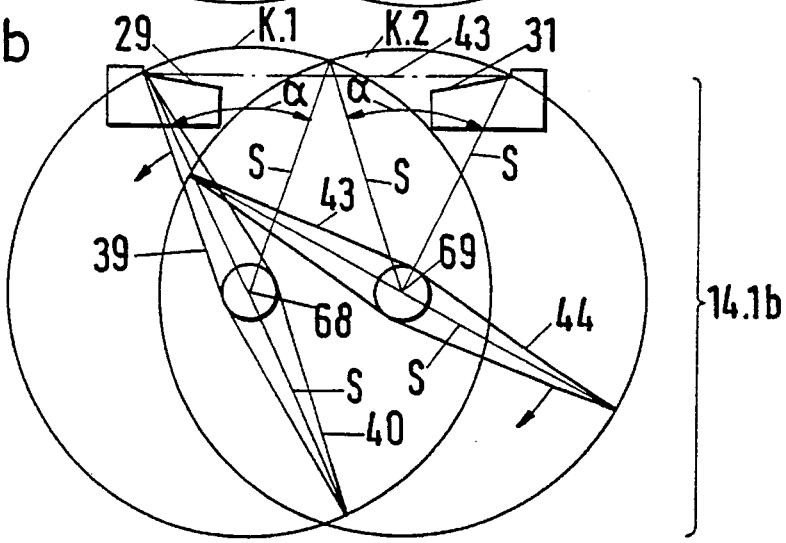
Figure 6:
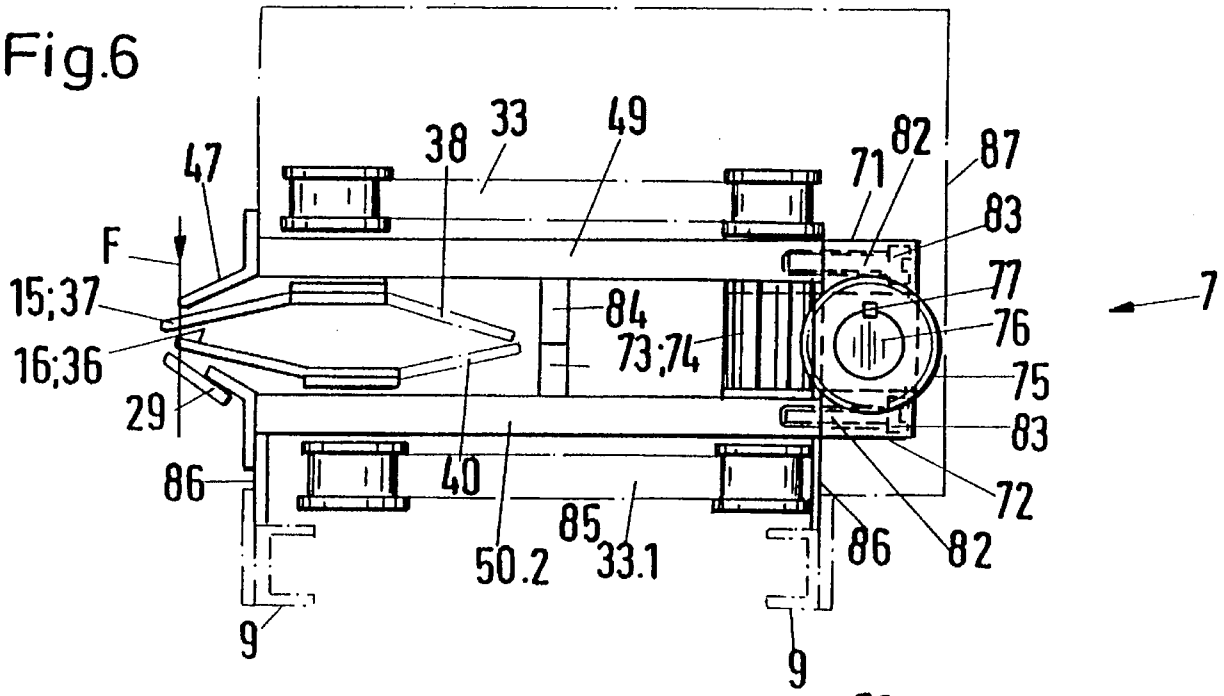
Figure 7:
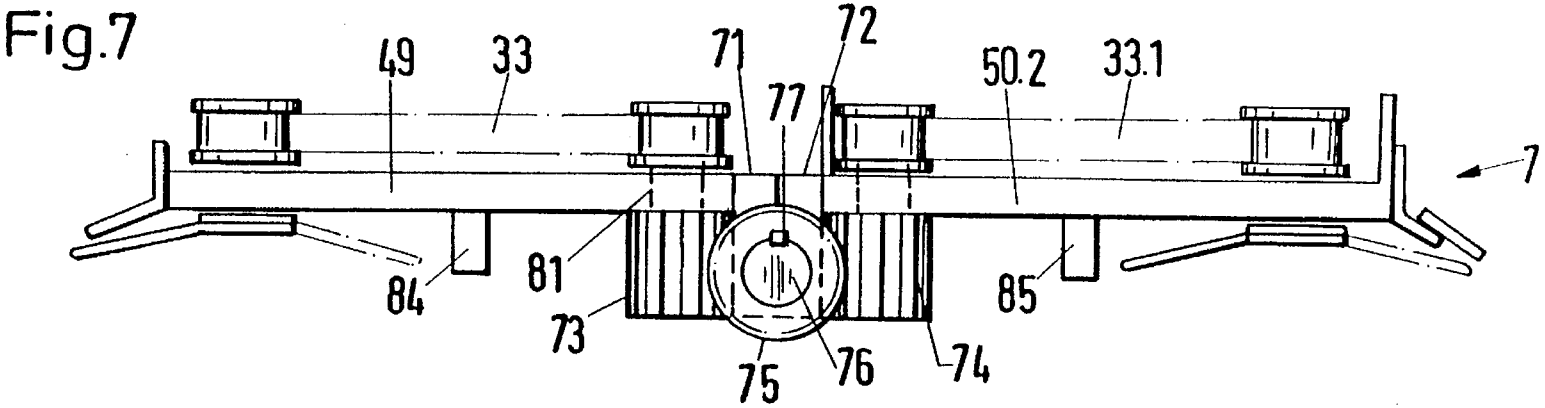
Figure 8:
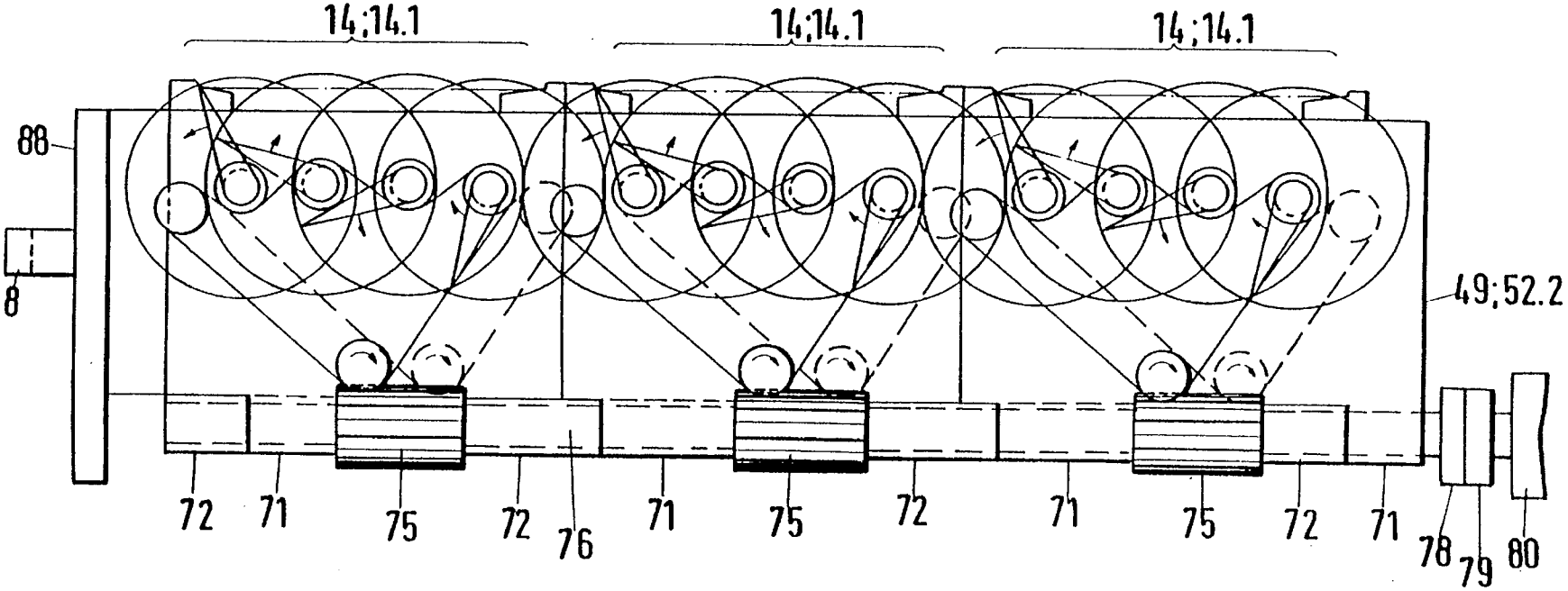
Figure 9:
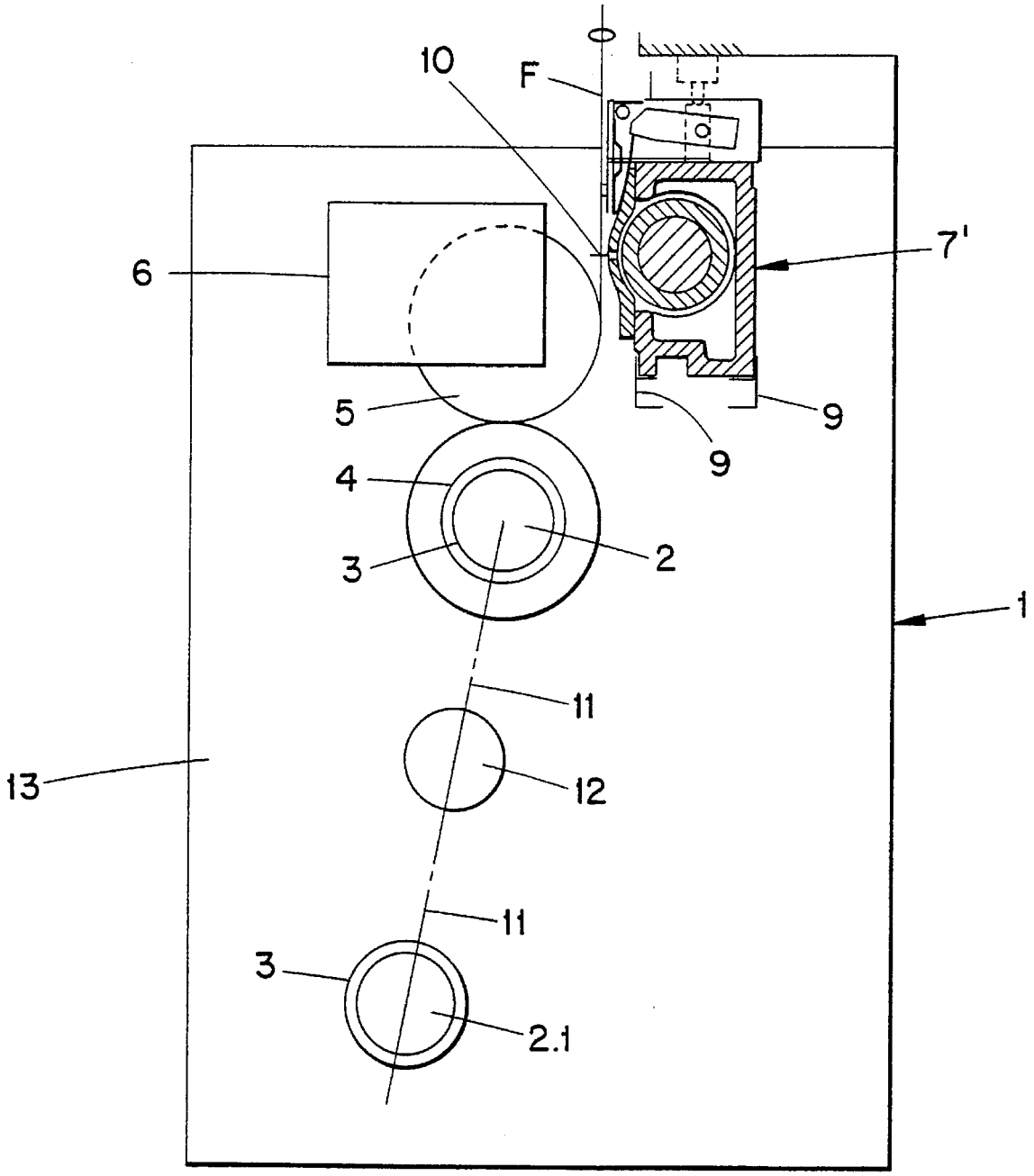
Figure 10:
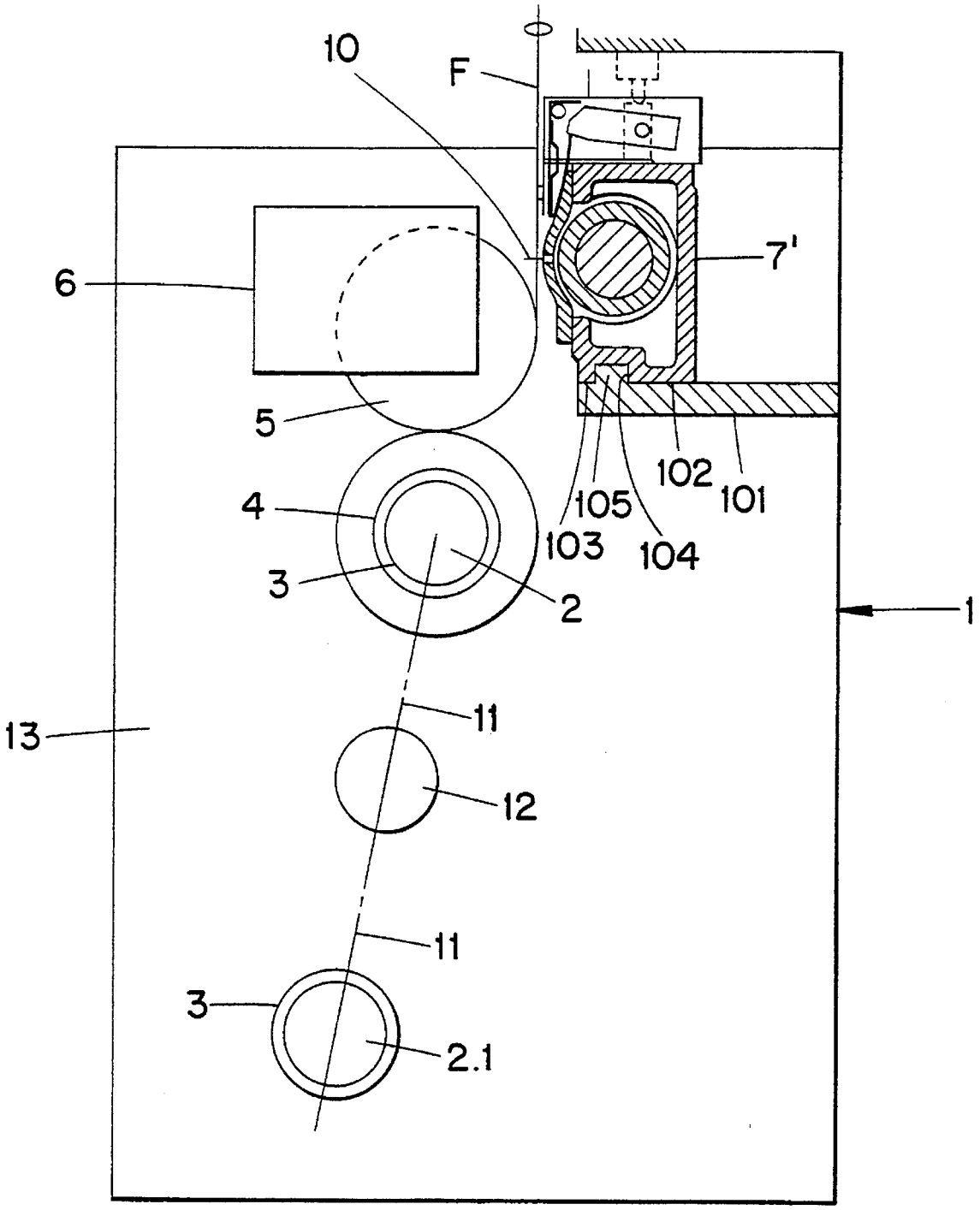

FIGS. 4, 4*a*, 4*b*, 4*a*.1, 4*a*.2, 4*b*.1 and 4*b*.2 are schematic and semi-schematic views of an embodiment of the traversing unit of FIG. 2 in accordance with the invention;

FIGS. 5, 5*a*, 5*b*, 5*a*.1 and 5*b*.1 show a modification of the traversing unit shown in FIGS. 4, 4*a*, 4*b*, 4*a*.1, 4*a*.2, 4*b*.1 and 4*b*.2;

FIGS. 6 and 7 each show a modification of the traversing units of FIGS. 2 and 3;

FIG. 8 shows a modification of a detail of the traversing unit of FIGS. 4, 4*a*, 4*b*, 4*a*.1, 4*a*.2, 4*b*.1 and 4*b*.2;

FIG. 9 is a semi-schematic front view of a bobbin winding machine similar to that illustrated in FIG. 1 except illustrating a cam traversing device rather than the wing traversing device; and FIG. 10 is a semi-schematic front view of a bobbin winding machine similar to that illustrated in FIG. 9 except illustrating a different arrangement for supporting and guiding the cam traversing device.

DETAILED DESCRIPTION OF PREFERRED EMBODIMENTS

Bobbin Winding Machine

FIG. 1 shows a bobbin winding machine 1 with a chuck 2 or 2.1, a tube 3 associated with each chuck 2 or 2.1, and a package 4 on the tube 3 of one chuck 2.

The chucks 2 and 2.1 are parts of a known so-called revolving bobbin changer, which for the purpose of changing a full package 4 to an empty tube 3 rotates about a rotational axle 12 in the known manner, so that a yarn F to be wound up can be brought from the full package 4 to the next following empty tube 3 without interrupting the winding process.

Yarn F is reciprocated by a thread guide 10 in the known manner and brought by means of a contact roller 5 onto an empty tube 3 or onto a package 4 which has already begun to receive yarn. The thread guide 10 is part of a traversing device 7 which is held on guide rails 9 and is removable from the bobbin winding machine 1 either manually by means of a handle 8 or by mechanical means (not shown).

The contact roller 5 is held in a rotatable and drivable manner in a contact roller casing 6. The contact roller casing 6 is attached in a stationary manner to a drive casing 13, in which the rotational axle 12 of a chuck carrier 11 belonging to the revolving bobbin changer is also held in a rotatable and drivable manner.

The insertion and positioning of a traversing device within a housing is described and shown in the above-mentioned European Patent Application No. 0272458A1 and corresponding U.S. Pat. No. 5,048,769, the entire disclosures of which are incorporated herein by reference. Thus, the insertion, support and positioning of the insertable traversing device shall not be described herein in detail.

One aspect of the present invention involves the provision of a bobbin winding machine that can wind yarn on an empty tube or package through use of either a wing traversing device 7 (described in more detail below) or a cam cylinder traversing device such as that illustrated and described in the aforementioned U.S. Pat. No. 5,048,769. FIG. 9 illustrates a cam traversing device 7' similar to that illustrated in the aforementioned U.S. Pat. No. 5,048,769 supported on the rails 9. The operation of the cam traversing device can be similar to that described in U.S. Pat. No. 4,674,694, the entire disclosure of which is incorporated herein by reference.

The cam traversing device 7' can be positioned and guided during insertion by the upstanding brackets secured to the outer faces of the rails 9. Of course, the rails 9 depicted in FIGS. 1, 2 and 9 are shown as an example of one way in which the traversing devices 7, 7' can be supported. It is also possible, however, to provide other guiding and carrying arrangements such as, for example, that shown in the above-mentioned U.S. Pat. No. 5,048,769 and European Patent Application No. 0272458A1. FIG. 10 illustrates such a guiding and carrying arrangement in which the cam traversing device 7' is supported on and carried by a carrier 101 by way of carrying areas 102, 103. The traversing device 7' is guided by way of the guiding areas 104, 105.

In the case of the bobbin winding machine illustrated in FIG. 10, it is to be understood that the configuration of the wing traversing device 7 generally depicted in FIGS. 1 and 2 would be modified slightly to conform to the configuration of the carrying and guiding areas 102, 103, 104, 105 illustrated in FIG. 10.

By providing a bobbin winding machine that is adapted to interchangeably receive either a wing traversing device (described below in more detail) or a cam traversing device, it is possible to employ a single bobbin winding machine for winding yarn with either type of traversing device.

Wing Traversing Unit

FIG. 2 shows a wing traversing unit 14 or 14.1 in a cross-sectional view which is part of the traversing device 7. Depending on the number of yarns to be simultaneously wound up on a chuck 2 or 2.1, the traversing device 7 is provided with a respective number of traversing units 14 or 14.1 arranged adjacent to one another, as shown in FIGS. 4*a*.1 to 4*b*.2.

The traversing unit 14, 14.1 of FIG. 2 shows so-called traversing wings, which, as shown in FIGS. 4, 4*a*, 4*b*, 4*a*.1, 4*a*.2, 4*b*.1 and 4*b*.2 or FIGS. 5, 5*a*, 5*b*, 5*a*.1 and 5*b*.1, are provided with different positions in the one or other direction according to the conveyance of the yarn. FIG. 2 further shows that they are each substantially opposite pairs of wings, as also shown in FIGS. 4 and 5, whose single wings are each driven separately, as illustrated in FIGS. 4*a*.1 and 4*b*.1, as well as FIGS. 5*a*.1 and 5*b*.1.

The wings shown in the unbroken lines are equivalent to the wings depicted in FIGS. 4, 4*a*, 4*b*, 4*a*.1, 4*a*.2, 4*b*.1 and 4*b*.2 which are described below, and the wings shown combined with the unbroken and dot-dash lines are equivalent to the wings of FIGS. 5, 5*a*, 5*b*, 5*a*.1 and 5*b*.1 described later.

FIG. 2 shows furthermore that the yarn F has a yarn course in accordance with the direction of the arrow from the top to the bottom.

With the help of the phrase "from the top to the bottom", the individual wings are designated below as "upper" or "lower" wings.

If FIG. 4 is viewed, which represents an arrangement of traversing wings in the direction of view I in FIG. 2 in CAD drawing style, there is provided an upper left outer wing (as seen within a view on the Figure) designated with reference numeral 15 and a lower left outer wing designated with reference numeral 16. The upper intermediate wings are designated with 17 and 18 and the lower intermediate wings with 19 and 20. Furthermore, an upper fight outer wing is designated with reference numeral 21 and a lower fight outer wing with reference numeral 22.

The predefined number of wing pairs per stroke length H.1 and the length of their wings, as seen from their rotational axis to their tip, is selected in such a way that lines of symmetry S, for example, which extend from adjacent points of intersections of the movement circles of the tips of wings 15, 17, 18, 21 or 16, 19, 20, 22, (e.g., the movement circles designated with numerals K.1, K.2, and K.3) to the rotational axes of wings 17 or 19 and 18 or 20, enclose an angle α of substantially 45 angular degrees. Thus, the angle α for the traversing wings 15, 16 represents the angular distance moved by the traversing wings 15, 16 as they rotate between a stroke arresting device 30 and the point at which the movement circle K.1 intersects the movement circle K.2. The angle α for the traversing wings 17, 19 represents the angular distance moved by the traversing wings 17, 19 as they rotate between the point of intersection of movement circles K.1 K.2 and the point of intersection of movement circles K.2, K.3. The angle α for the traversing wings 18, 20 represents the angular distance traveled by the traversing wings 18, 20 as they move between the point of intersection of movement circles K.2, K.3 and the point of intersection of movement circles K.3, K.4. Finally, with respect to the traversing wings 21, 22, the angle α represents the angular distance traveled by the traversing wings 21, 22 as they move between the point of intersection of movement circles K.3, K.4 and another stroke arresting device 32.

FIG. 4 further shows that the upper outer wings 15 and 21 (FIG. 4*a*) are displaced with respect to the lower outer wings 16 and 22 (FIG. 4*b*) in such a way that the tips of the upper outer wings 15 and 21 project further against the yarn F than the tips of the lower outer wings 16 and 22 so as to accept the yarn in this way.

Thus, as can be seen from the circular movements of the wings represented in FIG. 4, the yarn transfer is made from the lower outer wing 16 or 22 to the upper outer wing 15 or 21.

The displacement of the upper outer wings 15 or 21 with respect to the lower outer wings 16 or 22 is also recognizable from the rotational axles or axes of the outer wings which are shown in an offset manner, whereby the rotational axle or axis of the upper left outer wing 15 is designated with reference numeral 23 and the rotational axle or axis of the lower left outer wing 16 is designated by reference numeral 24. The rotational axle or axis of the upper right outer wing 21 is marked with 27 and the rotational axle or axis of the lower right outer wing 22 is marked with 28.

FIG. 4 also shows that the circular movements of the intermediate wings 17, 19 or 18, 20 are concentric, i.e., that the rotational axles or axes 25 and 25.1 are aligned for the intermediate wings 17 and 19 while the rotational axles or axes 26 and 26.1 are aligned for the intermediate wings 18 and 20.

In order to make the yarn transfer to the outer wings more precise, ramps 29 and 31 are provided, with ramp 29 being provided for the left outer wing 15, 16 and ramp 31 for the right outer wing 21, 22. FIG. 4*b*.1 further shows ramps 29 and the yarn guide 47 in accordance with FIGS. 4 and 4*b*.

Furthermore, ramp 29 may be provided with the aforementioned stroke-arresting device 30 and the ramp 31 with the aforementioned stroke-arresting device 32. The stroke-arresting devices 30, 32 are used to help precisely position the yarn at the end of the traversing stroke, frequently also known as traverse.

FIG. 4*a*.1 further shows a yarn guide 47 in a dot-dash line. The yarn guide may be provided with any random contour and need not necessarily be straight, but should preferably be straight.

Wing Drive

As is shown in FIGS. 4a.1 to 4b.2, all of the upper wings or all of the lower wings of a traversing unit 14.a or 14.b are each jointly driven by means of a belt drive 33 or 33.1. As a modification thereof, it is possible to use instead of the belt drive 33 or 33.1 toothed wheels in an arrangement (not shown) which exercises the same drive function.

FIGS. 4a.1 and 4a.2 show the wings of the upper row and FIGS. 4b.1 and 4b.2 show the wings of the bottom row. Accordingly, the reference numerals of FIGS. 4a and 4b are also used in FIGS. 4a.1 and 4a.2 and 4b.1 and 4b.2.

FIGS. 4a.1 and 4a.2 show three wing traversing units 14a, with one unit 14a per bobbin, arranged on a single whole base plate 49. However, the number is not limited to the three units, but depending on the number of bobbins there is provided one unit 14a per bobbin.

As can be seen from FIG. 2, the base plate 49 is provided for mounting the upper wings 15, 17, 18 and 21 while the base plate 50 is provided for mounting the lower wings 16, 19, 20 and 22.

As was already mentioned above, FIG. 4a.1 is drawn in the manner of a CAD drawing so that elements which are provided behind elements situated in front are not shown in dashed lines, but rather are shown in unbroken lines. The manner in which the elements are stacked behind one another is shown in FIG. 4a.2. This Figure shows the base plate 49 in the direction of view II (FIG. 4a.1) and below. This figure also illustrates the traversing units 14a as well as the rotational axles or axes 23, 25, 26 and 27 of the wings 15, 17, 18 and 21 which are rotatably held in the base plate 49 rotating about their rotational axles or axes (not shown in this Figure).

One belt drive 33 is provided for each wing traversing unit 14a above the base plate, and this belt drive 33 drives the wings 15, 17, 18 and 21 via rotational axles 23, 25, 26 and 27. The transmission element is a toothed belt 58 (the teeth of which are not shown).

As is shown in FIG. 4a.1, the toothed belt 58 extends per traversing unit 14a via a transmission pulley 53 and via driving pulleys 56, of which one pulley is provided for each wing, as well as via a deflection pulley 54 so as to impart the respective direction of rotation on the individual wings. It can be seen from the Figure that the belt drive drives the wings in the directions of rotation shown for each wing. That is, the traversing wings 15, 19, 18 and 22 rotate in the clockwise direction while the traversing wings 16, 17, 20, 21 rotate in the counterclockwise direction.

As is shown in FIG. 4a.2, the rotational axle 51 of the transmission pulley 53 is shown as being longer than the rotational axles 23, 25, 26 and 27, so that the transmission pulley 53 is also accordingly longer for receiving a belt transmission 34 which, as shown in FIG. 4a.1, is guided across two wing traversing units 14a via a tightener pulley 52. As is shown further in FIG. 4a.2, the third rotational axle 51 (as seen from the left to the right) is longer than the two previous axles of rotation 51 so that a main belt drive 36 can be received in addition to belt transmission 34. This main belt drive 36 is further guided around a displaceable tightener pulley 48, a deflection pulley 55 and a motor pinion 35. A turning moment, which is supplied from a drive motor 59 provided in a stationary manner in a drive casing (FIG. 1) to the motor pinion 35, is transmitted by the main belt drive 36 onto the belt transfer 34 and from this belt transfer 34 onto the belt drive 33.

Furthermore, as seen in FIG. 2, the upper transmission pulley 53 or 53.1 is connected by means of a shaft 66 to the lower transmission pulley 53a so that the turning moment of the transmission pulleys 53 or 53.1 can be transmitted to the transmission pulleys 53a and thus onto belt drive 33.1 or 33.3.

Furthermore, wings 16, 19, 20 and 22 are each provided with a drive pulley 56 which receives a toothed belt 58.1 in the respective manner so that the toothed belt transmits the direction of rotation (shown by the arrow) onto the wings. The toothed belt 58.1 is further guided around the deflection pulley 54 and the transmission pulley 53.a.

As has already been mentioned previously, the traversing device 7 is insertable, i.e., the motor pinion 35 will only engage the main belt drive 36 when the traversing device 7 has been inserted into its operating position.

If the traversing device 7 is not inserted, the belt guiding means extends in the way shown in the broken line of FIG. 4a.1, i.e., the tightener pulley 48 is in the position shown in broken lines so as to keep the belt of the main belt drive 36 tensioned even though the traversing device 7 has not been inserted.

Reference numeral 60 designates the rotational axle or axis of the deflection pulley 55. The rotational axles or axes of the deflection pulleys 54 and the tightener pulley 48 are not shown. For the sake of simplicity only belt drives 33, 33.1, 33.2 or 33.3 are shown in FIG. 2.

Thus, referring to FIG. 4, in order to move the yarn F from the left to the right of the package 4, the yarn is first contacted by the traversing wing 15 and is then successively contacted by the traversing wings 19, 18 and 22 in that order. At that point, the yarn F has reached the rightmost end of the package. To then move the yarn from the right to the left across the package as seen in FIG. 4, the yarn is first contacted by the traversing wing 21 and is thereafter successively contacted by the traversing wings 20, 17, 16, in that order. At that point, the yarn is located at the left end of the package. By continuing the above-described operation, the yarn is moved back and forth across the package until the package is filled.

Swivellability Of The Base Plate

FIGS. 4b.1 and 4b.2 show the arrangement of the lower wings in accordance with the invention, in which one unit base plate 50 swivellable about the rotational axle 51 is provided for each wing traversing unit 14b. The direction of swivel is indicated with the arrows 62, 62a and 62b.

The predefined distance between the whole base plate 49 and the individual unit base plates 50 is maintained by a spacer sleeve 61. The spacer sleeve 61 is provided with a bearing extension 64 whose diameter is smaller than the sleeve 61 and which swivellably receives the base plate 50 so as to swivel the base plates in accordance with the swivel arrows 62, or 62a, 62b about the rotational axle 51. The base plate 50 then sits close to the spacer sleeve 61 which is shown in FIG. 3 in full and in FIG. 4b.2 in a cut view.

In order to secure the swivelling of the base plate 50, each base plate 50 is provided with one or two facets 65, which are at least equivalent to a sector of circle with the swivelling radius R, whereby R extends from the rotational axle 51 and is equivalent to half the width B of the base plate 50. The facets 65 of the individual base plates 50 thus meet accordingly at a connecting line 63 which connects the rotational axles 51. If the base plates 50 are to be swivelled from the operating position as shown in FIG. 2 to the idle position shown in FIG. 3 (for exchanging or cleaning the wings, for example), a fixing screw 57 (FIG. 2) which presses against the beating extension 64 of the spacer sleeve 61 is loosened and thereafter the outermost base plate on the left is swivelled counter-clockwise by approximately 90° in the direction of the arrow 62, whereafter the base plate situated to the fight thereof is swivelled 180° in accordance with arrow 62*a* and finally the base plate 50 situated at the position on the far left is swivelled approximately a further 90° in the direction of arrow 62, so that the end position of said base plate is equivalent to the end position of the other base plates. As the last step, the outermost base plate 50 on the fight is swivelled 180° in the direction of arrow 62*b*.

In this swivelled position as shown in FIG. 3 of the base plates 50, the wings can be exchanged or cleaned easily without having to take apart the whole traversing device 7.

Similar to FIG. 4*a*.1, FIG. 4*b*.1 is provided with a CAD-like representation, which means that elements situated behind the base plate 50 in FIG. 4*b*.1 are not shown in broken lines, but rather are illustrated in unbroken lines. In order to clarify the position of the wings 16, 19, 20 and 22 and the drive of those wings, FIG. 4*b*.2 shows the effective position of drive 33.1 and wings 16, 19, 20 and 22 with respect to base plates 50.

FIGS. 5, 5*a*, 5*b*, 5*a*.1, 5*b*.1 show that in a reduced stroke H.2 as compared to a longer stroke H.1 of FIG. 4, two pairs of wings can be used instead of four pairs of wings which rotate opposite one another. The two pairs are required as double wings over the single wings of FIGS. 4, 4*a*, 4*b*, 4*a*.1, 4*a*.2, 4*b*.1 and 4*b*.2.

Similar to FIG. 4, FIG. 5 shows the mutual and relative position of the upper and lower wings. The upper left wing is composed of wing halves 37 and 38, as seen in FIG. 5, the fight upper wing is composed of wing halves 41 and 42, the lower wing on the left is composed of halves 39 and 40 and the lower wing on the right is composed of halves 43 and 44.

In order to maintain the offset arrangement of the upper wings with respect to the lower wings as shown in FIG. 2, the upper left wing 37/38 is rotatable about rotational axle or axis 67, the lower wing 39/40 is rotatable about the rotational axle or axis 68, the upper fight wing 41/42 is rotatable about the rotational axle or axis 70 and the lower right wing 43/44 is rotatable about the rotational axle or axis 69. The directions of rotation of the respective wings are shown by respective arrows indicating the direction of rotation. That is, the traversing wings 37/38 and 43/44 rotate in the clockwise direction while the traversing wings 41/42 and 39/40 rotate in the counterclockwise direction.

As was explained in connection with FIG. 4, the position of the wing halves of the double wings shown in FIG. 5 is also selected in such a way that the previously mentioned angles $\alpha$ are substantially 45 angular degrees. A corresponding explanation is therefore omitted with respect to FIGS. 5, 5*a*, 5*b*, 5*a*.1 and 5*b*.1.

As was already mentioned above, FIG. 5 shows the upper and the lower wing pairs, whereas FIG. 5*a* only shows the upper wings 37/38 and 41/42, and FIG. 5*b* only shows the lower wings 39/40 and 43/44. In FIG. 5 the whole traversing unit composed of the upper and lower wings is designated as reference numeral 14.1, whereas in FIG. 5*a* the upper wings of the traversing unit are designated with reference numeral 14.1*a* and in FIG. 5*b* the lower wings of the traversing unit are designated with reference numeral 14.1*b*. Furthermore, FIGS. 5*a* and 5*b* each show the yarn guide 47, and FIG. 5*b* also shows the ramps 29 and 31.

FIGS. 5*a*.1 and 5*b*.1 show in a similar manner as in FIGS. 4*a*.1 and 4*b*.1 an overall base plate 49.1 (FIG. 5*a*.1) on which are mounted the upper wing halves 37, 38, 41, 42 and a unit base plate 50.1 (FIG. 5*b*.1) on which are mounted the lower wing halves 39, 40, 43, 44. The base plates 50.1 swivel in an analogous manner to that described above for base plates 50. The connection and the drives also function in a similar manner as in FIGS. 4*a*.1 to 4*b*.2, and so these details shall not be repeated for FIGS. 5*a*.1 and 5*b*.1. Accordingly, elements with analogous functions are marked with analogous reference numerals.

To move the yarn from the left end of the package to the right end as seen in FIG. 5, the yarn is initially contacted by the traversing wing half 37 and is thereafter contacted by the traversing wing half 43. At that point, the yarn has reached the right end of the package. Thereafter, the yarn is contacted by the traversing wing half 42 and is then pushed to the left end of the package by the traversing wing half 40. Next, the yarn is contacted by the traversing wing half 38 and then by the traversing wing half 44 so that the yarn is moved to the right end of the package. Finally, to move the yarn back to the left end of the package, the yarn is contacted by the traversing wing half 41 and then by the traversing wing half 39. This sequence of operation is continued until the package is filled.

FIGS. 6 to 8 show a modification with respect to FIGS. 2, 3, 4, 4*a*, 4*b*, 4*a*.1, 4*a*.2, 4*b*.1, 4*b*.2 in that the drive of the transmission pulley 53 or 53.1 and 53*a* is not carried out by means of the belt transmission 34, but by means of a drive shaft 76 which transmits its turning moment via a drive pinion 75 to the transmission toothed wheels 73 and 74, which are shown in FIGS. 6 and 7 and which themselves drive the transmission pulleys 53 via a connecting shaft 81.

Shaft 76 is provided with a coupling half 78 which can be brought to a force-locked connection with a coupling half 79 of a drive motor 80 when the traversing device is pushed into the operating position. Similar to drive motor 59, drive motor 80 is disposed in a stationary manner in the drive casing 13.

The transmission toothed wheels 73 and 74 as well as the drive pinions 75 are provided with a matching helical gearing or spiral gearing. Furthermore, the base plate 49 is provided with hinge or bearing extensions 71, in which the shaft 76 is held rotatably and which is used as a left axial detent, as seen in a view on FIG. 8, for the position of the drive pinion 75.

In contrast to base plates 50 of FIGS. 4*a*.1 to 4*b*.2, the lower base plate 50.2 is continuous for all traversing units similar to base plate 49 and is provided with hinge or beating extensions 72, in which the shaft 76 is also held and which, on the other hand, form the right detent, as seen in a view on FIG. 8, for the position of the drive pinion 75. Sliding blocks 77 are provided for transmitting the turning moment from shaft 76 onto drive pinion 75.

For mounting or dismounting the hinge or bearing extensions 71 and 72 plus shaft 76 and drive pinion 75, the hinge and bearing extensions 71 are each attached with connecting screws 82 to base plate 49 or 50.2.

To allow the base plate 50.2 to be swivelled into the opened position as shown in FIG. 7, the screw heads 83 of the connecting screws 82 are sunk-in.

The ability to swivel out the base plate 50.2 in the manner as is shown in FIG. 7 also allows the wings to be cleaned or exchanged in a convenient position.

The features illustrated in FIGS. 6–8 which are not described or designated are similar to those described above in connection with the other drawing figures and so are not described in detail here.

A spacing means 84 is attached to base plate 49 and a spacing means 85 is attached to base plate 50.2. The spacing devices 84, 85 are disposed close to one another when the base plates 49 and 50.2 are in the position shown in FIG. 6. This ensures or maintains the distance between the wings of the two base plates.

Supports 86 are used as legs on which the traversing device 7 can be pushed into the operating position on rails 9 by a handle 8 extending from a front plate 88.

Finally, the traversing units 14 to 14.1 are housed in a casing 87.

The principles, preferred embodiments and modes of operation of the present invention have been described in the foregoing application. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fail within the spirit and scope of the present invention as defined in the claims, be embraced thereby.

What is claimed is:

1. A bobbin winding machine for winding up at least one textile yarn comprising at least one chuck for receiving a yarn, a contact roller for the transfer of the yarn guided by a traversing device to the chuck, and means for alternately receiving two different types of said traversing device, the two different types of said traversing device including a wing traversing device and a cam cylinder traversing device.

2. A bobbin winding machine as claimed in claim 1, wherein the wing traversing device is provided with several wing traversing units to permit multi-yarn winding on the chuck.

3. A bobbin winding machine as claimed in claim 2, wherein at least the wing traversing device is provided with an optionally predefinable stroke length.

4. A bobbin winding machine as claimed in claim 3, wherein the wing traversing units are provided with a plurality of rotatable wings which are adapted to the stroke length.

5. A bobbin winding machine as claimed in claim 1, wherein the wing traversing device has a plurality of rotatable wings, the wings of the wing traversing device being arranged in such a way that each wing moves through an angle $\alpha$ of substantially 45° from a position in which the wing receives a yarn to a subsequent position in which the wing delivers the yarn.

6. A bobbin winding machine as claimed in claim 1, wherein the wing traversing device has a plurality of rotatable wings, the wings of the wing traversing device being drivable by a transmission that includes one of a toothed belt transmission and a toothed wheel transmission.

7. A bobbin winding machine as claimed in claim 6, wherein the transmission and a motor for driving the transmission are arranged with respect to one another in such a way that the motor is coupled fully to the transmission when the traversing device has been fully inserted.

8. A bobbin winding machine as claimed in claim 7, wherein the motor is arranged in a stationary manner.

9. A bobbin winding machine as claimed in claim 1, wherein the wing traversing unit includes at least two pairs of wings for traversing the yarn each stroke with wings arranged substantially mutually opposed, whereby rotational axles of the wing pairs causing a reversal of the stroke of the yarn are arranged mutually offset in such a way that a receiving wing projects further against the yarn and further in the direction of the stroke than a wing delivering the yarn.

10. A bobbin winding machine as claimed in claim 9, including a ramp provided at end zones of the stroke to make a yarn transfer more precise.

11. A bobbin winding machine as claimed in claim 10, wherein a detent is provided on the ramp for the yarn to serve as a stroke arresting device.

12. A bobbin winding machine for winding up at least one textile yarn, comprising at least one chuck for receiving the yarn and a contact roller for the transfer of the yarn guided by a traversing device to the chuck, the traversing device being a wing traversing device with two base plates connected together and arranged mutually opposed and at least one wing arranged in a drivable and rotatable manner on each base plate, the at least one wing of one of the base plates being arranged in opposing relation to the at least one wing of the other base plate, and a joint drive provided for driving the wings, the one base plate being displaceable to an idle position remote from the other base plate while the one base plate and the other base plate are connected together.

13. A bobbin winding machine as claimed in claim 12, wherein the other base plate is an overall base plate for receiving a row of wings and the one base plate receives another wing row, and the one base plate of the traversing device being arranged rotatably by 180 angular degrees about a rotational axle.

14. A bobbin winding machine as claimed in claim 12, wherein the one base plate is displaceable while maintaining a connection of the wings to the joint drive.

15. A bobbin winding machine as claimed in claim 12, wherein the one base plate is arranged to be swivelled relative to the other base plate.

16. A bobbin winding machine as claimed in claim 15, wherein the one base plate is arranged swivellably about a rotational axle of a shaft jointly driving the wings.

17. A bobbin winding machine as claimed in claim 12, wherein the one base plate is subdivided into units.

18. A bobbin winding machine as claimed in claim 17, wherein the one base plate is subdivided into at least two units, each unit being separately swivellable relative to the other unit.

19. A bobbin winding machine as claimed in claim 18, wherein each unit is separately swivellable about a rotational axle of a shaft jointly driving the wings.

20. A bobbin winding machine for winding at least one textile yarn, comprising a chuck for receiving a yarn being wound, means for removably positioning and supporting a first traversing device which guides the yarn back and forth with respect to the chuck utilizing a cam cylinder and for removably positioning and supporting a second traversing device which guides the yarn back and forth with respect to the chuck utilizing a plurality of wings, and a contact roller for transferring the yarn guided by one of the traversing devices to the chuck.

21. A yarn traversing device for guiding a yarn back and forth along a chuck to produce a yarn package, comprising a first base plate having at least one rotatably driven wing mounted thereon, and a second base plate spaced from the first base plate, said second base plate being connected to the first base plate and having at least one rotatably driven wing mounted thereon, said second base plate being movable relative to the first base plate between a first position in which the at least one wing mounted on the second base plate is positioned so as to rotate in conjunction with the at least one wing on the first base plate to guide the yarn along the chuck and a second position in which the at least one wing on the second base plate is positioned so as to be accessible for servicing, said second base plate being movable relative to the first base plate between the first and second positions while the second base plate is connected to the first base plate.

22. A yarn traversing device as claimed in claim 21, including a driving arrangement for simultaneously rotatably driving the at least one wing on the first base plate and the at least one wing on the second base plate.

23. A yarn traversing device as claimed in claim 21, wherein the at least one wing on the first base plate and the at least one wing on the second base plate each includes two wing halves that are rotatably driven about a common axis.

24. A yarn traversing device as claimed in claim 21, wherein the first base plate and the second base plate each have four rotatable wings mounted thereon, and including a driving arrangement for simultaneously driving the four wings on the first base plate and the four wings on the second base plate, two of the wings on the first base plate being rotatably driven in a direction opposite that of the other two wings on the first base plate, and two of the wings on the second base plate being rotatably driven in a direction opposite that of the other two wings on the second base plate.

25. A yarn traversing device as claimed in claim 19, wherein the second base plate includes a plurality of separate base plate units that are rotatable relative to one another between the first position and the second position, each base plate unit having a plurality of rotatable wings mounted thereon.

26. A yarn traversing device as claimed in claim 19, wherein the first base plate and the second base plate each have more than two wings mounted thereon which are each rotatable about respective rotational axes, the rotational axes of two of the wings on the first base plate being aligned with the rotational axes of two of the wings on the second base plate.

27. A bobbin winding machine for winding up at least one textile yarn, comprising at least one chuck for receiving the yarn and a contact roller for the transfer of the yarn guided by a traversing device to the chuck, the traversing device including two base plates on each of which is mounted at least one wing, the two base plates being connected together and the wings being arranged in a rotatable manner on the base plates, the at least one wing on one of the base plates being positioned in opposing relation to the at least one wing on the other base plate, and the one base plate being movable relative to the other base plate to an idle position remote from the other base plate while the two base plates are connected together.

28. A bobbin winding machine as claimed in claim 27, including a joint drive for rotatably driving the wings on the two base plates.

29. A yarn traversing device for guiding a yarn back and forth along a chuck to produce a yarn package, comprising a first base plate having at least one rotatably driven wing mounted thereon, and a second base plate connected to the first base plate and having at least one rotatably driven wing mounted thereon, said second base plate being movable relative to the first base plate while the first and second base plates are connected between a first position in which the at least one wing mounted on the second base plate is positioned to rotate in conjunction with the at least one wing on the first base plate to guide the yarn along the chuck and a second position in which the at least one wing on the second base plate is positioned to be accessible for servicing.

30. A yarn traversing device as claimed in claim 29, including a joint drive for driving the wings on the two base plates.

* * * * *